US010046364B2

(12) United States Patent
Ashley et al.

(10) Patent No.: US 10,046,364 B2
(45) Date of Patent: Aug. 14, 2018

(54) MODULAR EXCITER BEAM

(71) Applicant: Schenck Process Australia Pty Ltd., North Ryde (AU)

(72) Inventors: Gordon Ashley, Erskineville (AU); Simon Gerard Mann, South Perth (AU); James Matthew Burgess, Randwick (AU); Philip Morris, Modautal (DE); Rotem Shalem, Marouba (AU); Martin Thomaier, Riedstadt (DE)

(73) Assignee: Schenck Process Australia Pty. Lt., North Ryde (AU)

( * ) Notice: Subject to any disclaimer, the term of this patent is extended or adjusted under 35 U.S.C. 154(b) by 0 days.

(21) Appl. No.: 15/357,211

(22) Filed: Nov. 21, 2016

(65) Prior Publication Data

US 2017/0066017 A1 Mar. 9, 2017

Related U.S. Application Data

(63) Continuation of application No. PCT/AU2015/000301, filed on May 21, 2015.

(30) Foreign Application Priority Data

May 21, 2014 (AU) ..... 2014901891

(51) Int. Cl.

| | |
|---|---|
| ***B07B 1/34*** | (2006.01) |
| ***B07B 1/28*** | (2006.01) |
| ***B07B 1/42*** | (2006.01) |
| ***B06B 1/16*** | (2006.01) |

(52) U.S. Cl.
CPC ..... *B07B 1/284* (2013.01); *B06B 1/16* (2013.01); *B07B 1/42* (2013.01)

(58) Field of Classification Search
CPC ..... B06B 1/16; B07B 1/42; B07B 1/284
USPC ..... 209/346
See application file for complete search history.

(56) References Cited

U.S. PATENT DOCUMENTS

| | | | | |
|---|---|---|---|---|
| 3,089,582 A * | 5/1963 | Musschoot | ..... | B65G 27/18 198/761 |
| 5,494,173 A * | 2/1996 | Deister | ..... | B07B 1/42 209/326 |
| 6,830,155 B2 * | 12/2004 | Trench | ..... | B07B 1/284 209/274 |

(Continued)

FOREIGN PATENT DOCUMENTS

| | | |
|---|---|---|
| GB | 2 034 437 A | 6/1980 |
| WO | WO 02/11905 A1 | 2/2002 |
| WO | WO 02/11908 A1 | 2/2002 |

(Continued)

OTHER PUBLICATIONS

Extended European Search Report for European Application No. 15796591.4 dated Sep. 21, 2017.

*Primary Examiner* — Terrell H Matthews
(74) *Attorney, Agent, or Firm* — Muncy, Geissler, Olds & Lowe, P.C.

(57) ABSTRACT

A modular exciter beam fitted to a vibratory screen assembly. The exciter beam spans between opposing side walls of the screen assembly. The modular exciter beam provides mounting for a pair of exciter mechanisms which are located substantially inside the side walls of the screen assembly.

17 Claims, 14 Drawing Sheets

(56) References Cited

U.S. PATENT DOCUMENTS

2003/0230526 A1* 12/2003 Okabayshi ..... B01D 33/0376
210/388

FOREIGN PATENT DOCUMENTS

WO WO 2008/115673 A1 9/2008
WO WO-2008115673 A1 * 9/2008 ..... B07B 1/4645
WO WO 2014/177910 A1 11/2014

* cited by examiner

MODULAR EXCITER BEAM

This nonprovisional application is a continuation of International Application No. PCT/AU2015/000301, which was filed on May 21, 2015, and which claims priority to Australian Patent Application No. 2014901891, which was filed in Australia on May 21, 2014, and which are both herein incorporated by reference.

BACKGROUND OF THE INVENTION

Field of the Invention

The present invention relates broadly to a modular exciter beam of a vibratory screen assembly.

Description of the Background Art

In a conventional vibrating screen, an exciter beam is a major structural component. The exciter beam provides the connection between an exciter mechanism and side walls of the vibrating screen. The exciter mechanism generates the required vibration to assist in separation of crushed minerals or ores according to their size fractions. The exciter beam of existing designs is of a unitary construction, typically prefabricated by welding structural members together. In a variation on this design, the exciter beam is in the form of a relatively heavy gauge pipe at each end having flanged connectors for fastening to the side wall of the vibratory screen. The exciter mechanism is mounted to a pair of exciter mounting platforms which clamp either side of the side wall of the vibratory screen. The exciter mechanism is thus positioned directly above the side wall so that the direction of excitation is in the plan of the side wall. This exciter beam arrangement is disclosed in international patent application no. PCT/AU2001/00955.

SUMMARY OF THE INVENTION

According to an exemplary embodiment of the invention there is provided a modular exciter beam of a vibratory screen assembly, the modular beam including a pair of end fittings each adapted to provide support for an exciter mechanism, the end fittings designed to mount to an inside face of respective and opposing side walls of the vibratory screen assembly wherein the exciter mechanisms are located substantially inside the side walls, and including a connection member at each of its ends detachably coupled to respective of the end fittings which together with the connection member transmit forces from the exciter mechanisms to and between the side walls of the vibratory screen assembly.

According to an exemplary embodiment of the invention there is provided a vibratory screen assembly including a pair of opposing side walls between which one or more screen elements are mounted, including a modular exciter beam having a pair of end fittings mounted to an inside face of respective of the pair of opposing side walls, a connection member at each of its ends detachably coupled to respective of the end fittings, and a pair of exciter mechanisms each mounted to respective of the pair of end fittings to locate substantially inside the side walls wherein the exciter mechanisms transmit forces to and between the side walls via the modular exciter beam.

The end fittings can each be box-like having chamber walls of a thickness dependent on stresses imposed on the end fitting by its corresponding exciter mechanism. More preferably the end fitting includes one or more internal stress webs interconnecting one or more of the chamber walls. The box-like end fitting can be of a unitary design. Generally the end fitting can be cast.

The end fitting can include a platform to which the corresponding exciter mechanism mounts, the platform located entirely inside the side walls of the screen assembly. The platform can extend at least partly beyond the chamber walls with at least some fastening holes exposed for fastening of the corresponding exciter mechanism external of the end fitting. Alternatively at least some fastening holes exit within the end fitting for fastening internally of the fitting.

The end fittings can each include one or more access windows in the chamber walls designed to provide access for fastening of the end fitting to either the corresponding side wall or the exciter mechanism. At least one of the access windows can align with a corresponding access window in the side wall of the screen assembly.

The connection member at each of its ends can include a flanged connector for detachable coupling to the respective end fitting via a plurality of fasteners. The end fittings can each include a corresponding flanged connector for detachable coupling to the flanged connector of the connection member. Still more preferably the connection member detachably connects to the end fittings independent of their connection to the side walls of the vibratory screen assembly. Alternatively the modular exciter beam can include a clamp connector for detachably coupling the connection member at each of its ends to the respective end fitting.

The connection member can be a tubular member. The connection member can have, for example, a round cross-section.

The connection member can be prefabricated in a predetermined length dependent on the separation between the opposing side walls. The connection member can be tubular and of a diameter and wall thickness dependent on the forces.

Generally the modular exciter beam can be configured to retrofit to an existing vibratory screen assembly.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
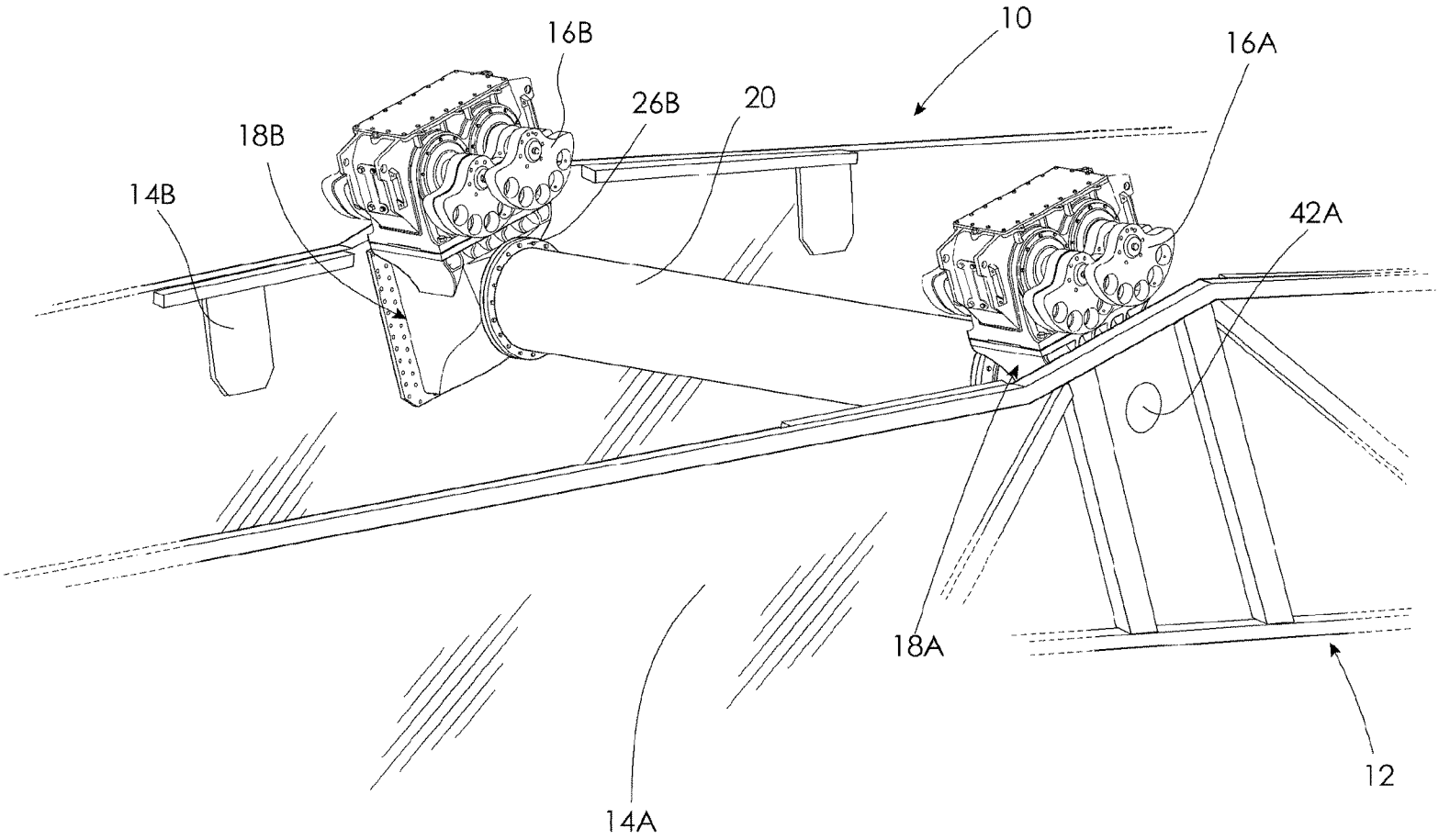
FIG. 1 is a schematic view of an embodiment of a modular exciter beam installed in a vibratory screen assembly.

As shown in FIG. 1 there is a modular exciter beam 10 according to an embodiment of the invention fitted to a vibratory screen assembly 12. The modular exciter beam 10 spans between opposing side walls 14A and 14B of the screen assembly 12. In this embodiment the modular exciter beam 10 provides mounting for a pair of exciter mechanisms 16A and 16B which are located substantially inside the side walls 14A and 14B of the screen assembly 12.

Figure 2A:
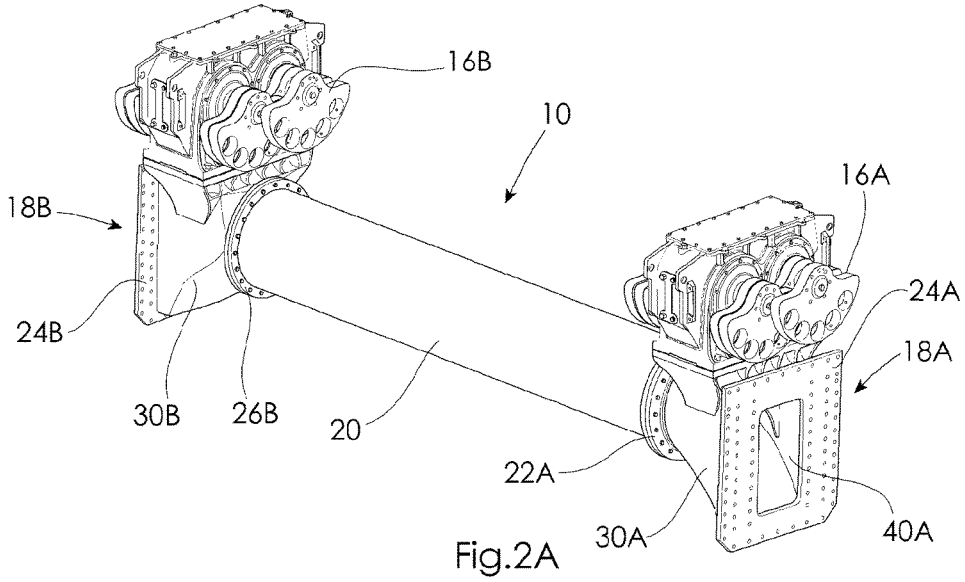
FIGS. 2A and 2B are perspective and end elevational views of the modular exciter beam together with associated exciter mechanisms taken from FIG. 1.
Figure 2B:
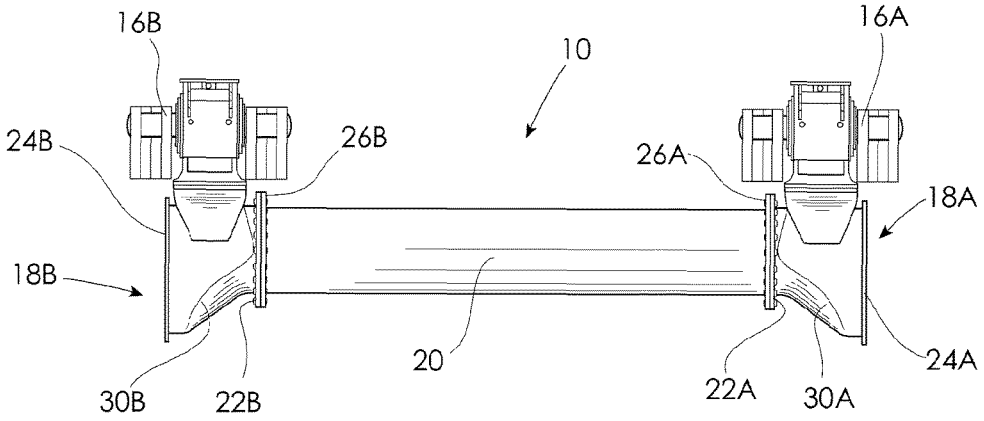
Figure 3:
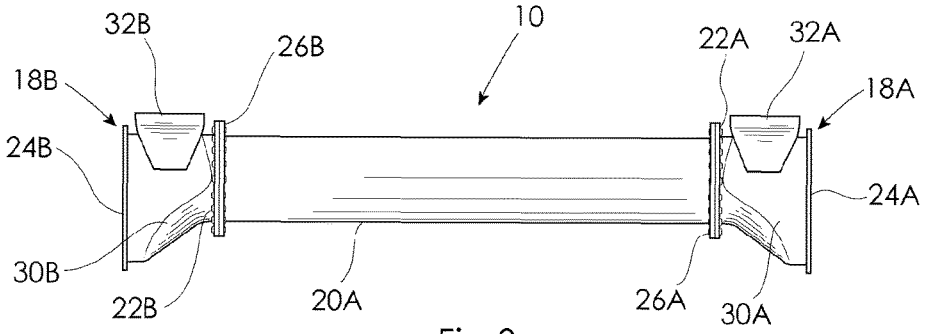
FIG. 3 is an end elevational view of the modular exciter beam of the preceding illustrations but without the exciter mechanisms.

As further illustrated in FIGS. 2 and 3 the modular exciter beam 10 of this example comprises a pair of end fittings 18A and 18B mounted to an inside face of respective of the side walls 14A and 14B. The end fittings 18A and 18B also provide support for respective of the exciter mechanisms 16A and 16B. The modular exciter beam 10 also comprises a connection member 20 at each of its ends detachably connected to respective of the end fittings 18A and 18B. The connection member 20 together with the end fittings 18A and 18B transmit forces from the exciter mechanisms 16A/B to and between the side walls 14A/B of the screen assembly 12. The connection member 20 is designed to transmit a range of the forces imposed on the modular exciter beam 10 by the integration with the screen frame with the material being processed within the screen frame. These forces include torsion, bending, buckling, and shear forces either alone or in any combination. The connection member 20 in conjunction with the end fittings 18A and 18B interconnect and spans between the side walls 14A and 14B to strengthen them where they may otherwise be susceptible to buckling. The end fittings 18A and 18B are designed to withstand stresses imposed on the modular exciter beam 10 and the effective length of the connection member 20 is thus reduced compared with prior art arrangements.

The modular exciter beam 10 of this first embodiment has application with a range of vibratory screen assemblies. However, the dual exciter mechanisms 16A/B are best suited to relatively heavy duty applications in which case the vibratory screen assembly can weigh up to 50 tonnes. It is expected that vibratory screen assemblies of this weight may vary in size from between around 3.5 meters to 5 meters in width. The modular exciter beam itself may weigh up to around 4 tonnes. It should however be understood that the modular exciter beam has a range of applications and is not limited to these weights and/or dimensions. The modular exciter beam 10 of this example is well suited to retrofitting to an existing vibratory screen assembly. The dual exciter mechanisms 16A/B together with the modular exciter beam 10 may for example replace a triple exciter assembly.

Figure 4A:
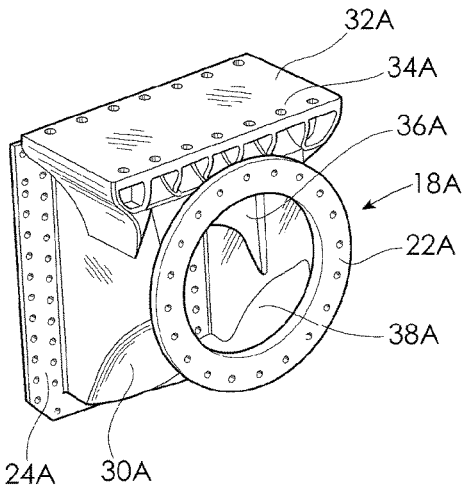
FIGS. 4A and 4B are front and rear perspective views of an end fitting of the modular exciter beam of the embodiment of the preceding illustrations.
Figure 4B:
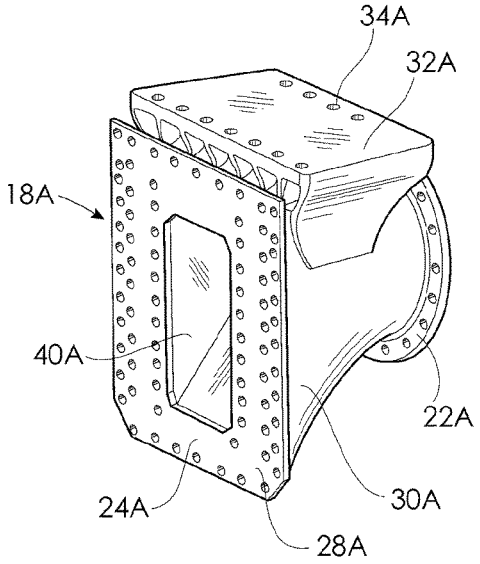
Figure 5:
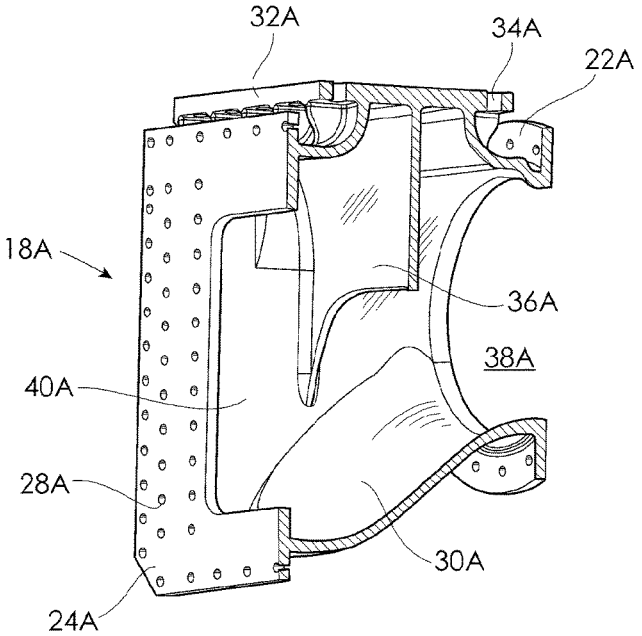
FIG. 5 is a cutaway rear perspective view of the end fitting of FIGS. 4A and 4B.

As best shown in FIGS. 4 and 5 the end fittings such as 18A are of a box-like construction which in this embodiment is a unitary casting. Cast end fittings such as 18A are preferred as the wall thickness in the casting can be tailored depending on for example stress analysis results which are computer-modelled for the particular installation. The end fitting 18A includes a pair of opposing flanged connectors 22A and 24A for connection to the connection member 20 and the side wall 14A respectively. The flanged connector 22A is circular and is detachably coupled to a corresponding flanged connector 26A of the connection member 20. The other flanged connector 24A is generally square-shaped having a plurality of fastening holes such as 28A for connection to the side wall 14A of the screen assembly 12. The fastening holes such as 28A are positioned to align with corresponding fastening holes (not shown) in the side wall 14A. The connection member 20 thus connects to each of the end fittings 18A and 18B independent of their connection to the side walls 14A and 14B, respectively.

The box-like end fittings such as 18A include chamber walls 30A which diverge from the circular flanged connector 22A to the square flanged connector 24A. The end fitting 18A also includes a platform 32A upon which the corresponding exciter mechanism such as 16A mounts. The platform 32A extends partly beyond chamber walls 30A with which it is integrally formed. The platform 32A is provided with fastening holes such as 34A outside the chamber walls 30A. These fastening holes such as 34A are thus exposed for fastening of the corresponding exciter mechanism 16A to the platform 32A external of the end fitting 18A.

The end fittings such as 18A are cast in a wall thickness dependent on stresses imposed on the end fitting such as 18A by its corresponding exciter mechanism 16A. The end fitting 18A may also include an internal stress web such as 36A interconnecting the chamber walls 30A. In this example the internal stress web 36A is oriented vertically and partly bridges the chamber walls 30A whilst also being cast integral with the platform 32A. The end fitting 18A is otherwise hollow with access windows 38A and 40A provided inside of respective of the circular flanged connector 22A and the square flanged connector 24A. In this embodiment the access window 40A provides access for complete fastening of the end fitting 18A to the corresponding side wall 14A of the screen assembly 12. This access window aligns with a corresponding access window or port 42A in the side wall 14A (see FIG. 1).

The connection member 20 is in this embodiment prefabricated in a predetermined length including its flanged connectors such as 26A. The connection member 20 is in this example a circular pipe having a wall thickness or gauge dependent on the forces exerted by the exciter mechanisms 16A/B. In the relatively heavy duty application of the dual exciter assembly of this embodiment the pipe is likely to be of a nominal diameter between 400 mm to 950 mm. It is expected that a wall thickness of around Schedule 40 will be suitable for this application. In any case the pipe or the connection member 20 is generally of standard dimensions requiring that it is only prefabricated in length depending on the separation of the side walls such as 14A and 14B for the particular installation.

Figure 6:
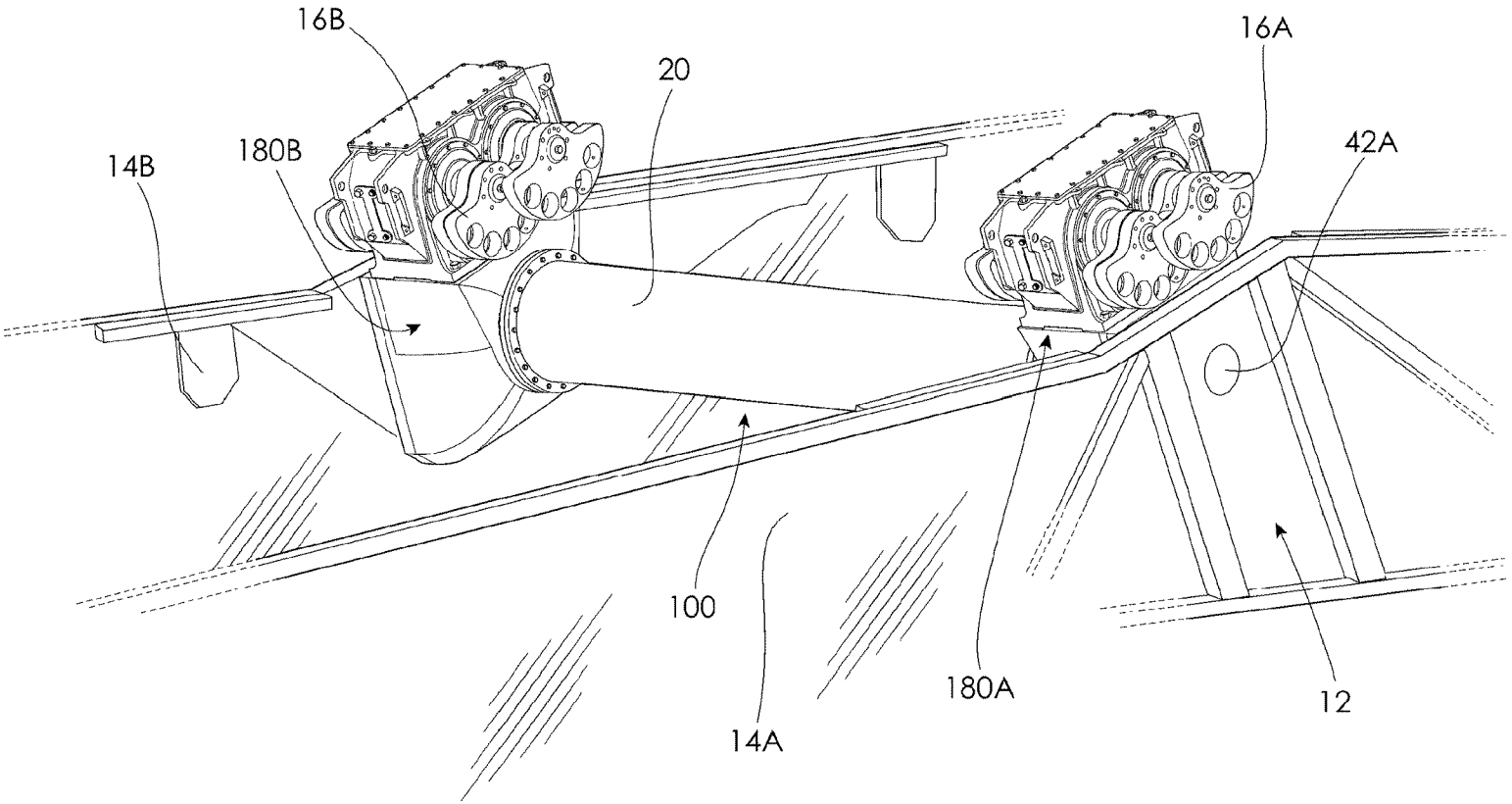
FIG. 6 is a perspective view of an embodiment of a modular exciter beam installed in a vibratory screen assembly.

FIG. 6 illustrates a variation on the modular exciter beam 10 of the preceding embodiments. This alternative design is effectively the same as the preceding embodiment except for differences in the end fittings. For this reason those components of the embodiment which are identical to the preceding first embodiment have been designated with the same reference numerals. The alternative end fittings 180A and 180B of the exemplary embodiment have on the other hand been designated with an additional "0" including for example the internal stress web 360A.

Figure 7A:
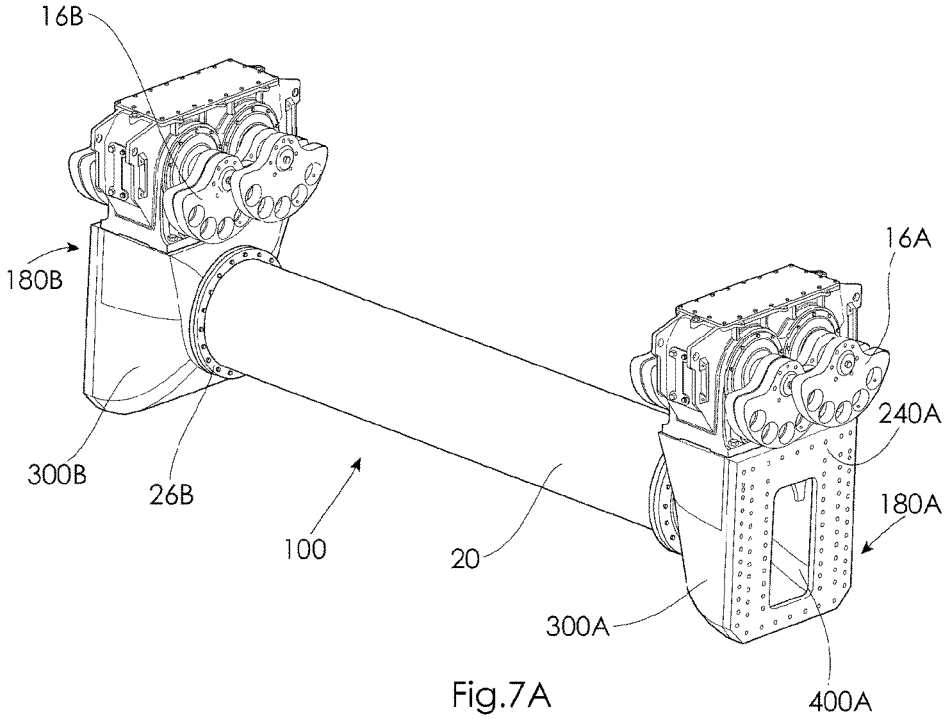
FIGS. 7A and 7B are perspective end elevational views of the modular exciter beam together with its associated exciter mechanisms taken from FIG. 6.
Figure 7B:
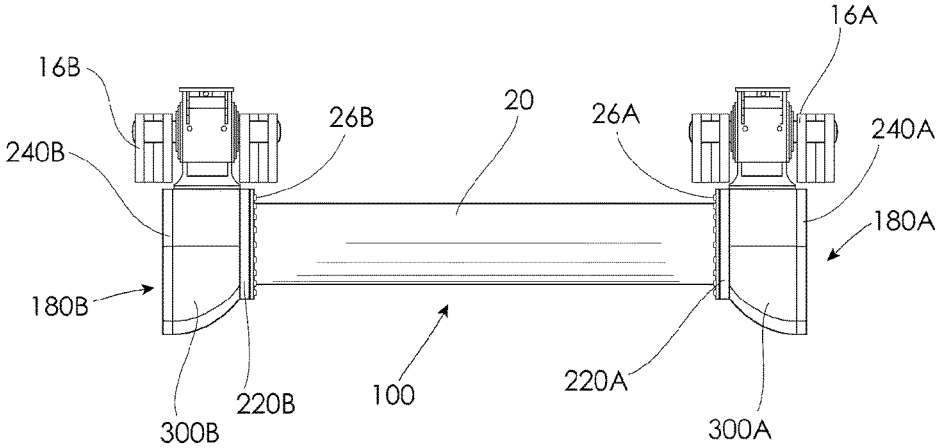
Figure 8A:
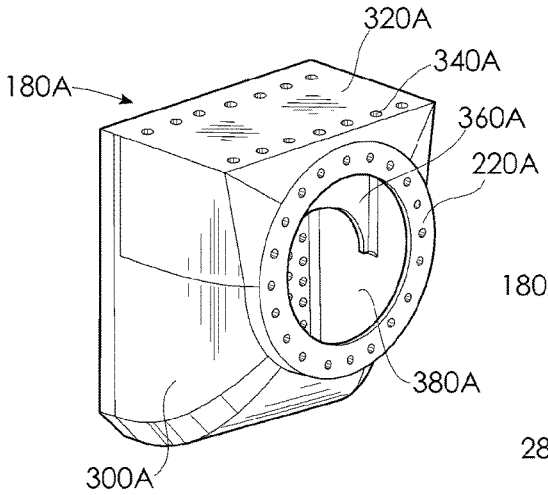
FIGS. 8A and 8B are front perspective and rear views of an end fitting of the modular exciter beam of FIGS. 6 to 8.
Figure 8B:
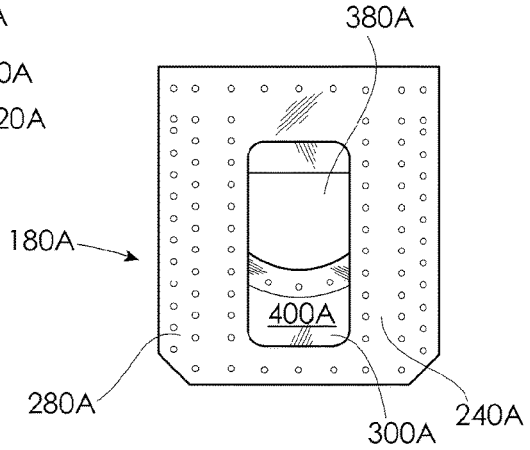
Figure 9:
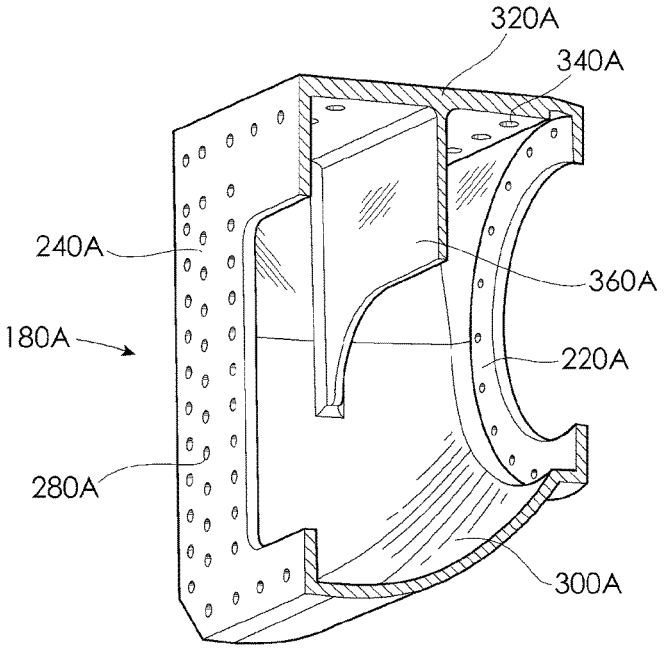
FIG. 9 is a cutaway perspective view of the end fitting of FIGS. 8A and 8B.
Figure 10:
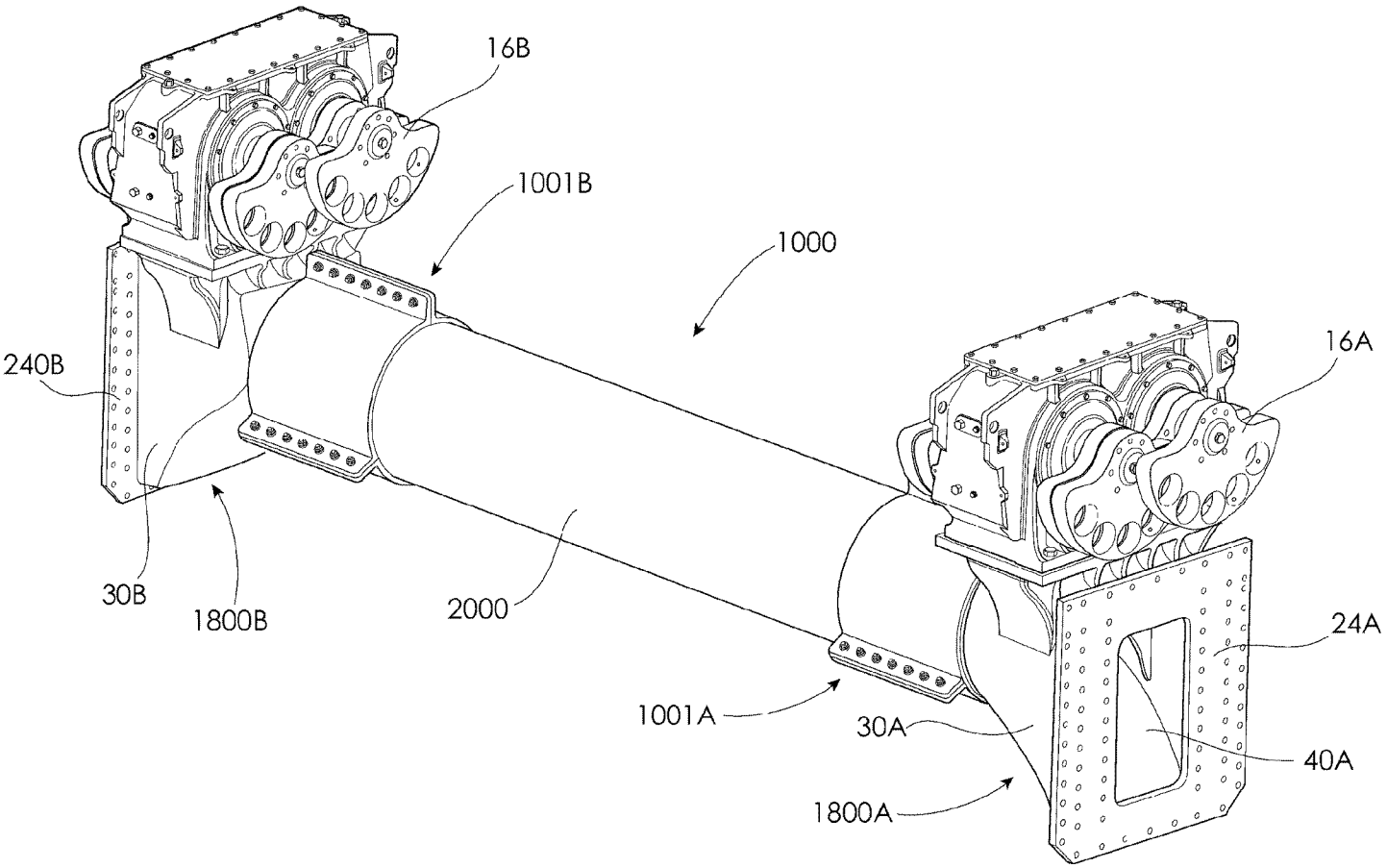
FIG. 10 is a perspective view of an embodiment of a modular exciter beam together with its associated exciter mechanisms.

FIGS. 7 and 8 further depict this exemplary embodiment of the modular exciter beam 100 with its end fittings 180A and 180B. FIGS. 9 and 10 show one of the end fittings 180A in greater detail with at least the following departures from the first embodiment:

The platform 320A is in effect an integral part of the chamber walls 300A;

The flanged connector 220A is directed internally as opposed to the external connector flange 22A of the first embodiment;

The other flanged connector 240A is also directed internally and in effect provides part of the chamber walls 300A unlike the other flanged connector 24A of the first embodiment which at least in part is an external flange.

The alternative end fitting 180A provides for fastening internally of the fitting. This internal fastening extends to the connection member 20, the exciter mechanism such as 16A, and the associated side wall 14A. The access window 40A provides access for fastening of the connection member 20 to the end fitting 180A. It also provides access for fastening of the exciter mechanism 16A to the corresponding platform 320A. If required, the other access window 38A provides access for fastening the exciter mechanism 16A or clamping of the end fitting 180A to the side wall 14A.

Figure 11:
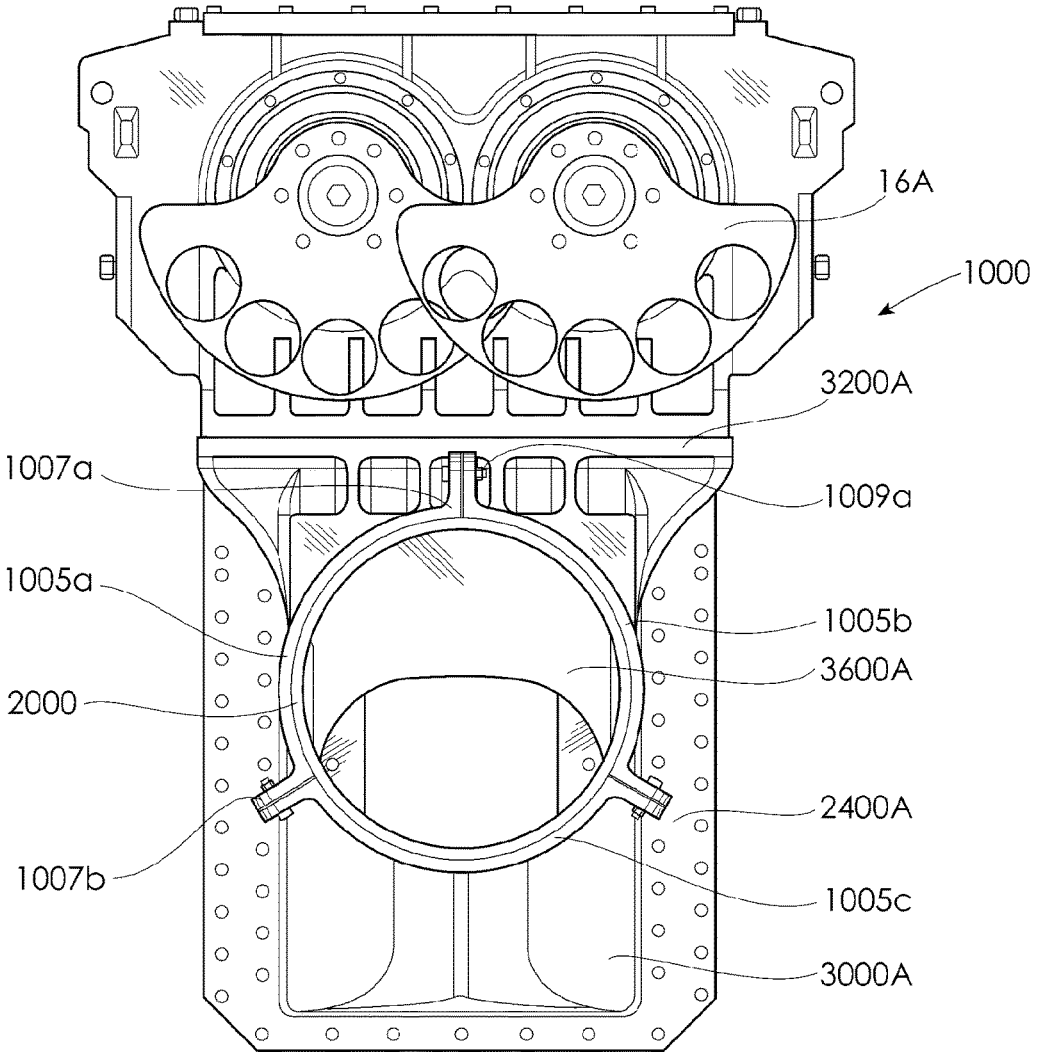
FIG. 11 is a front view sectioned through the connection member of the modular exciter beam of FIG. 10.
Figure 12:
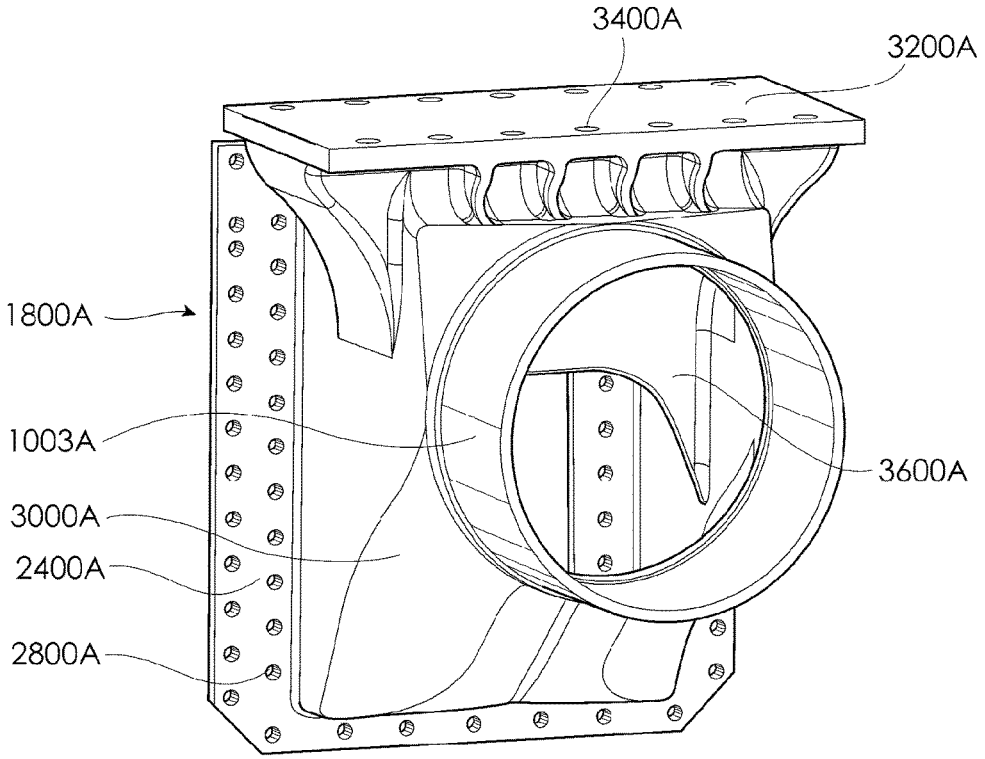
FIG. 12 is a front perspective view of an end fitting of the modular exciter beam of FIGS. 10 and 11.

FIGS. 10 to 12 illustrate an exemplary embodiment of a modular exciter beam 1000 according to the invention. This embodiment of the modular exciter beam 1000 departs from the previous embodiments in at least the following respects:

The connection member 2000 is detachably coupled to respective of the end fittings 1800A and 1800B via a clamp coupling 1001A and 1001B;

The end fittings such as 1001A include a spigot such as 1003A for clamping by the clamp coupling 1001A.

The end fitting such as 1000A is otherwise substantially identical to the first embodiment of FIGS. 1 to 5. In this exemplary embodiment, the clamp coupling as best shown in FIG. 11 includes three (3) clamp segments 1005*a* to 1005*c* which together circumscribe the connection member 2000 and the spigot 1003A. Each of the segments such as 1005*a* includes a pair of axially aligned and radially extending flanges 1007*a* and 1007*b*. The coupling flange 1007*a* of one of the coupling segments 1005*a* is clamped via a series of clamp fasteners such as 1009*a* to an adjacent coupling flange of the adjacent coupling segment 1005*b*. This clamped connection arrangement replaces the earlier described flanged connections between the connection member such as 20 and the end fittings 18A/B. This clamped connection arrangement requires no prefabrication of the connection member 20 which is merely cut to length.

Figure 13:
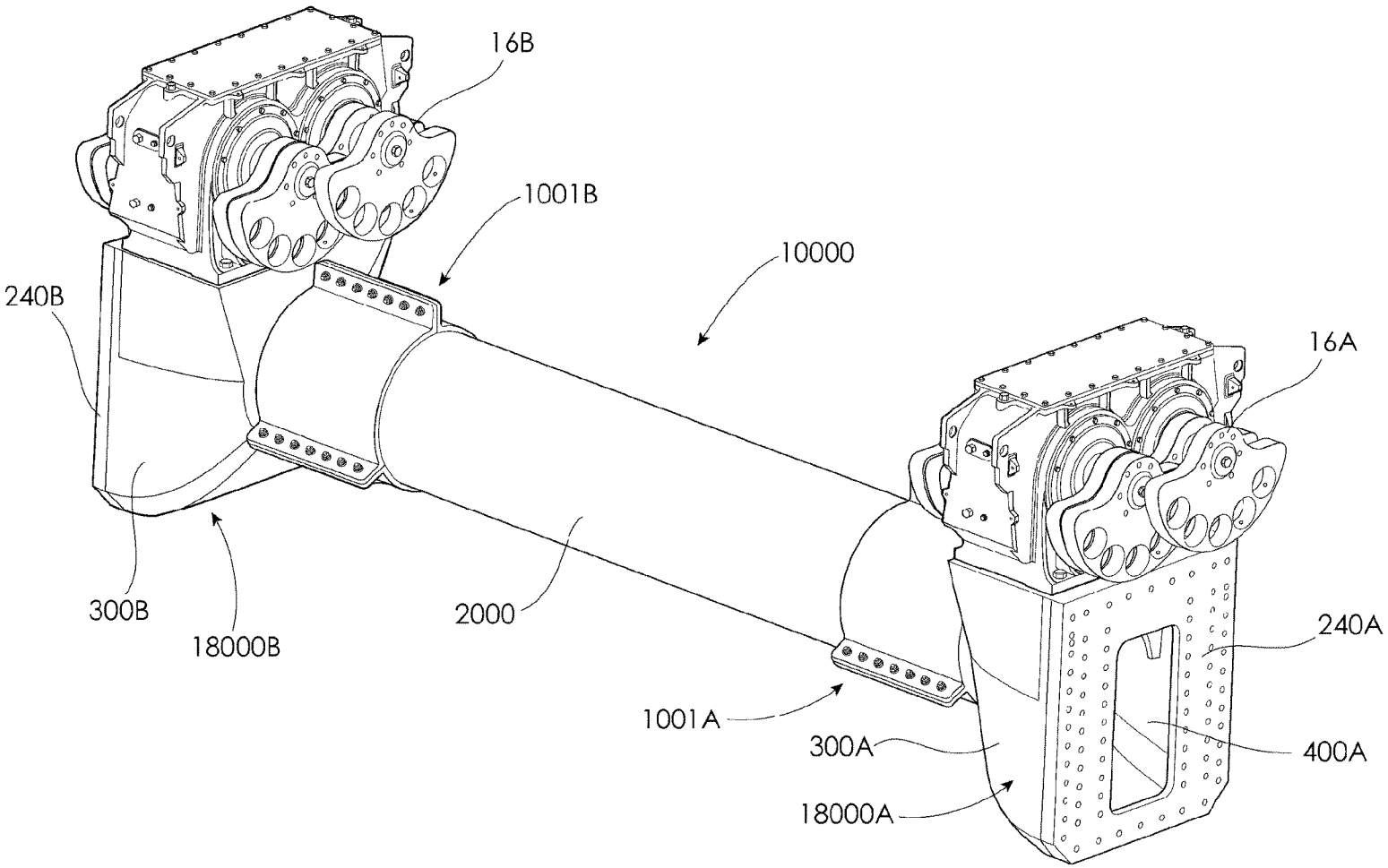
FIG. 13 is a perspective view of an embodiment of a modular exciter beam together with its associated exciter mechanisms.
Figure 14:
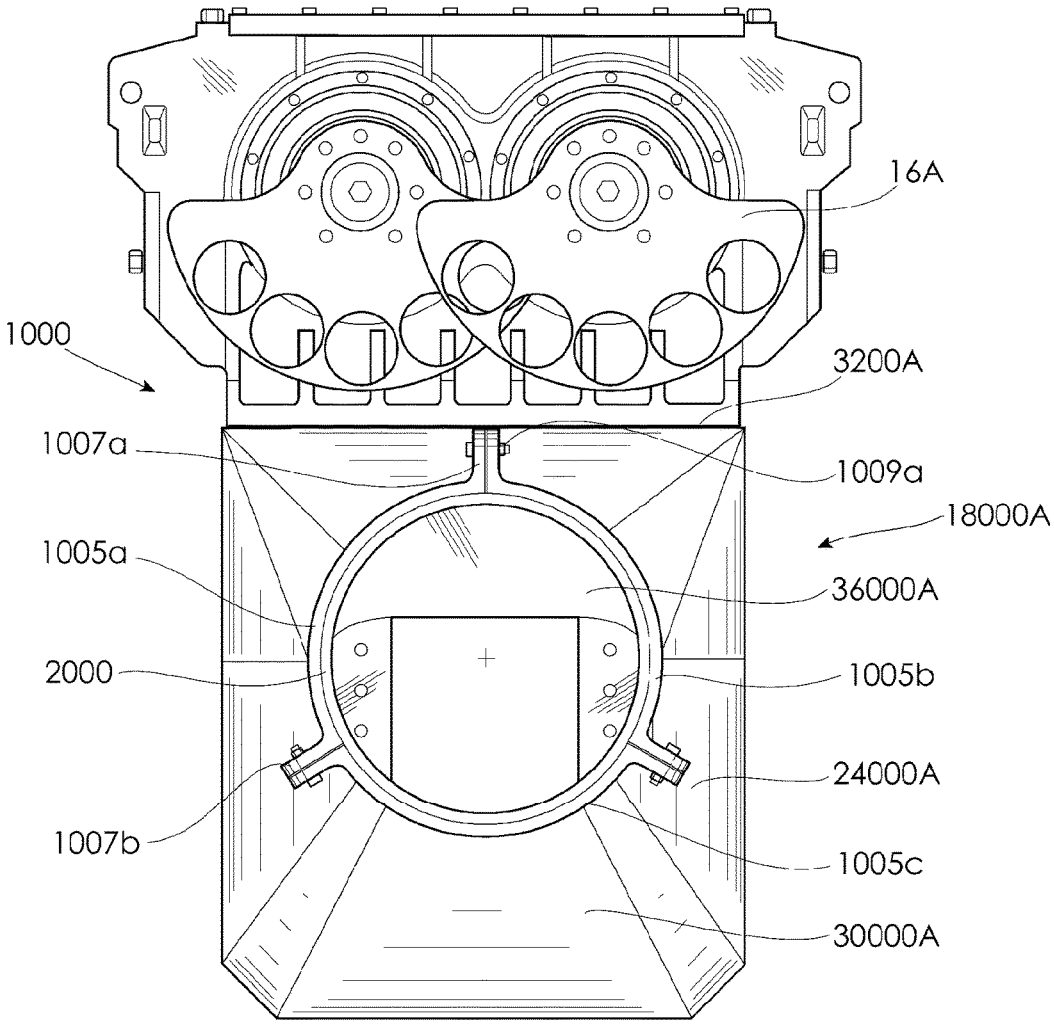
FIG. 14 is front view sectioned through the connection member of the modular exciter beam of FIG. 13.
Figure 15:
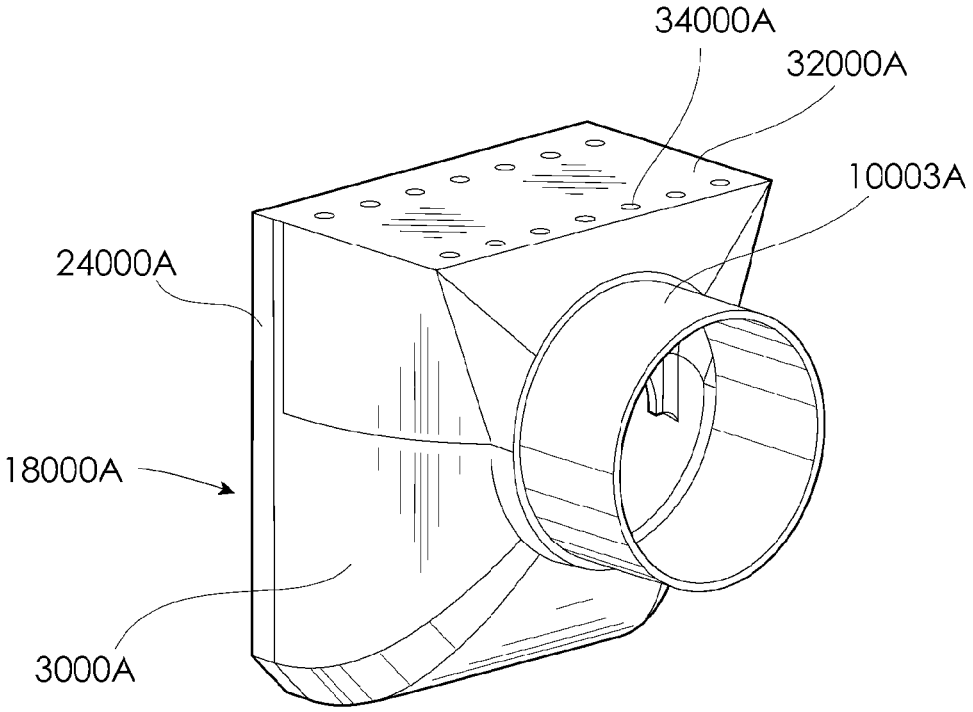
FIG. 15 is a front perspective view of an end fitting of the modular exciter beam of FIGS. 13 and 14.

FIGS. 13 to 15 depict an embodiment of a modular exciter beam 10000 which is substantially identical to the exemplary embodiment but with a different end fitting. The end fittings such as 18000A are similar to the end fittings such as 100A of the embodiment of FIGS. 6 to 9. The end fittings 18000A otherwise include a spigot such as 10003A to be clamped by the clamp coupling 1001A.

Figure 16:
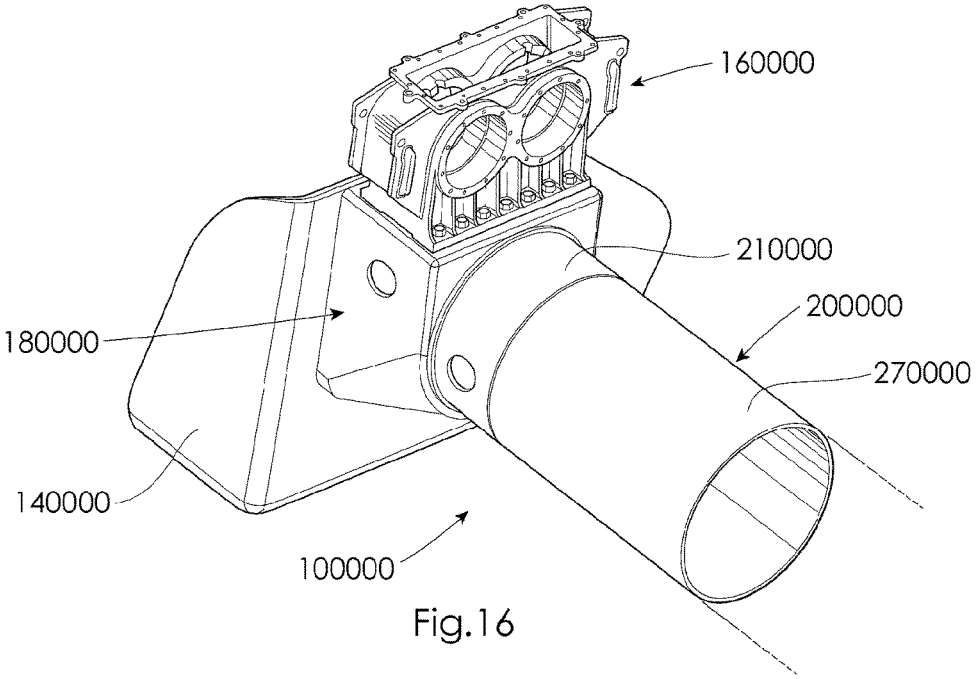
FIG. 16 is a perspective view of an embodiment of half of a modular exciter beam installed in a vibratory screen assembly.
Figure 17:
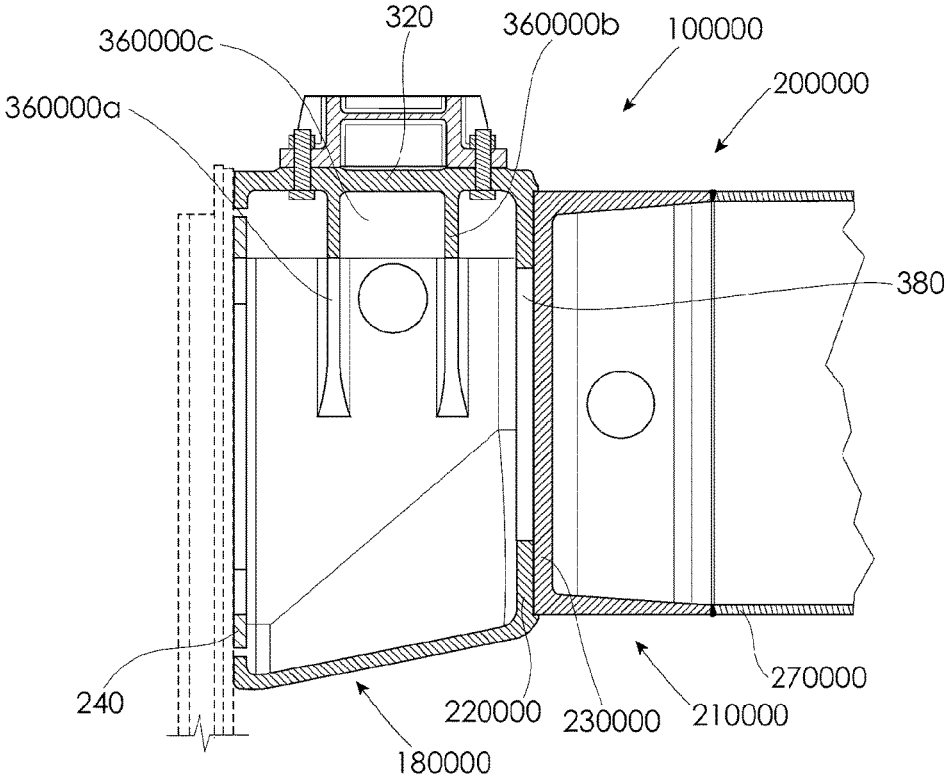
FIG. 17 is a sectional view taken through the modular exciter beam of FIG. 16 without the exciter mechanism.
Figure 18:
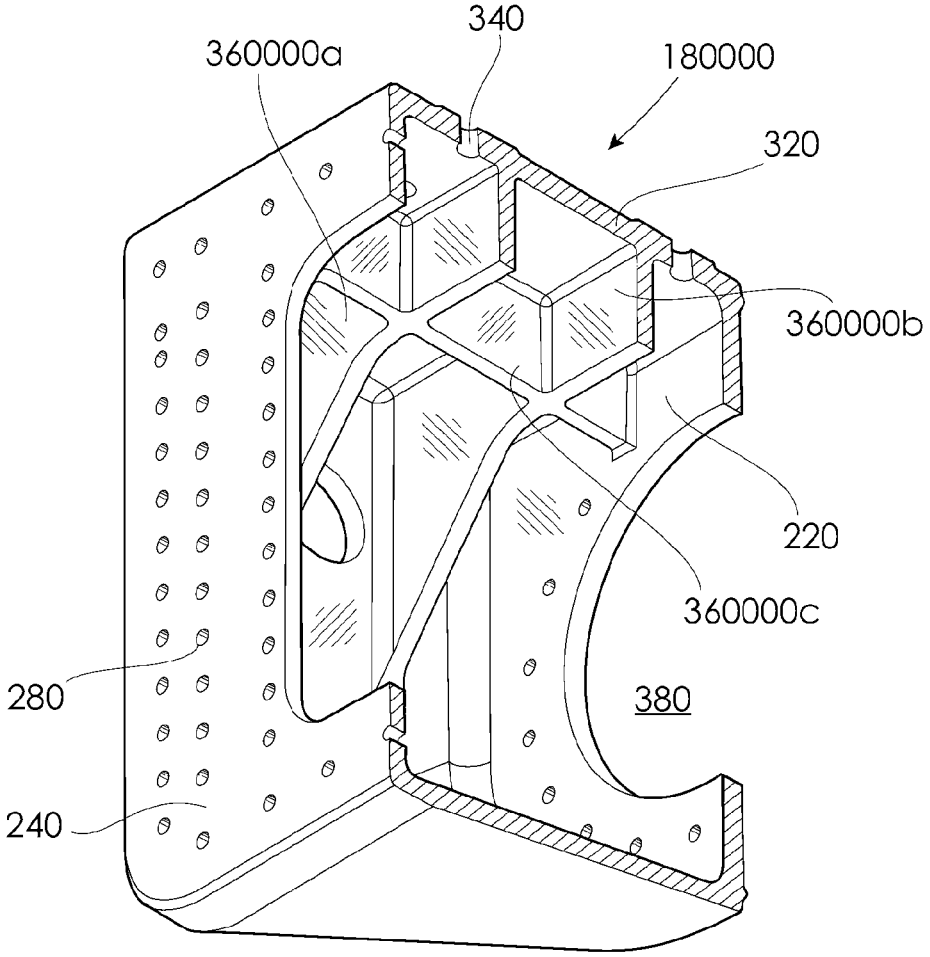
FIG. 18 is a sectional view taken in perspective of the end fitting of the modular exciter beam of FIGS. 16 and 17.

FIGS. 16 to 18 illustrate an embodiment of a modular exciter beam 100000 which is similar to the above described embodiment but with the following variations:

the end fittings such as 180000 include additional internal stress webs such as pair of transverse webs 360000*a/b* together with longitudinal ribs 360000*c/d;* the connection member 200000 includes a transition unit such as 210000 at each of its respective ends.

The transition unit such as 210000 effectively replaces the external flange connector 26A/B of the exemplary embodiment. The transition unit 210000 includes an internal flanged connector 23000 which is fastened to the flange connector 220000 off the end fitting 180000. The transition unit 210000 is in this example welded to a pipe such as 270000 of substantially the same dimensions. The transition unit 210000 has its wall thickness tapered or progressively increased as it approaches mounting to the end fitting 180000. In this embodiment the wall thickness of the internal flanged connector 230000 and the flange connector 220000 of the end fitting 180000 are substantially the same. The transition unit such as 210000 is in this example cast and its tapered perimeter wall provides relief in the casting process.

In all embodiments the modular exciter beam may be assembled and installed in the following manner. These steps are particular applicable to retrofitting the modular exciter beam such as where, for example:

The end fittings 18A and 18B are each fastened to respective of the side walls 14A and 14 of the vibratory screen assembly 12;

The connection member at each of its ends is secured to respective of the end fittings 18A and 18B;

Each of the exciter mechanisms such as 16A is mounted to the platform 32A of the corresponding end fitting 18A.

It will be appreciated that the sequence of these assembly steps may vary depending on the particular installation. For example, steps 2 and 3 may be reversed where the exciter mechanisms 16A/16B are mounted to the respective end fittings 18A/18B prior to connecting the connection member 20 to the end fittings 18A and 18B. The modular exciter beam may be entirely assembled in-situ or transported at least partly assembled, for example, without the exciter mechanisms mounted to the end fittings.

In these embodiments the modular exciter beam is designed so that the exciter mechanisms are located substantially inside the side walls of the vibratory screen assembly. This means the modular exciter beam installation, particularly in a retrofit, is within existing volumes or spaces available for plant.

Now that several preferred embodiments of the invention have been described it will be apparent to those skilled in the art that the modular exciter beam has at least the following advantages over the admitted prior art:

The exciter beam and its associated exciter mechanisms are designed to fit within the existing "footprint" of plant;

The modular nature of the exciter beam lends itself to assembly and installation in different forms depending on the application;

The modular exciter beam includes end fittings which together with the intermediate connection member transmit forces to the side walls of the screen assembly;

The end fittings are "symmetrical" in a sense that they can be fitted to both ends of the connection member;

The modular exciter beam can be designed with standard connection members, for example flanged pipe of a standard diameter and gauge.

Those skilled in the art will appreciate that the invention described herein is susceptible to variations and modifications other than those specifically described. For example, the connection member need not be circular pipe and may for example be square or rectangular in cross-section or a combination of shapes. The mounting or securement of the connection member to the end fittings may involve a combination of internal and external fasteners and this may also apply to the side wall and exciter mechanism mounting. The clamped coupling of the connection member to its end fittings may vary from that described where for example clamping is achieved by a tapered sleeve design. The end fittings may vary in shape and configuration largely dependent on stresses imposed by the exciter mechanisms. The various components of the modular exciter beam, in particular the end fittings and transition unit, need not necessarily be cast but alternatively may be manufactured by machining, forging, fabrication or any combination of these techniques.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A modular exciter beam of a vibratory screen assembly, the modular beam comprising:

a pair of end fittings that each provide support for an exciter mechanism, the end fittings designed to mount to an inside face of respective and opposing side walls of the vibratory screen assembly, such that the exciter mechanisms supported on the pair of end fittings are located substantially between the side walls; and a connection member, each end of the connection member being detachably coupled to a respective one of the end fittings, which together with the connection member transmit forces from the exciter mechanisms to and between the side walls of the vibratory screen assembly, wherein each of the end fittings is formed as a housing, wherein walls of the housing are chamber walls that enclose a chamber therein, wherein each of the end fittings have a first flanged connector that connects to the connection member and a second flanged connector that mounts to the inside face of the side walls, wherein the chamber walls extend between the first flanged connector and the second flanged connector, such that the first flanged connector is provided at a first end of the housing and the second flanged connector is provided at a second end of the housing, and wherein each of the end fittings is a unitary, cast component.

2. A vibratory screen assembly comprising:

a pair of opposing side walls between which one or more screen elements are mounted; and a modular exciter beam including:

a pair of end fittings disposed between the pair of opposing side walls, so that each of the end fittings is mounted to a respective inside face of the pair of opposing side walls;

a connection member, each end of the connection member being detachably coupled to a respective one of the end fittings; and a pair of exciter mechanisms, each mounted to a respective one of the end fittings in the pair of end fittings, the pair of exciter mechanisms being arranged substantially between the side walls, wherein the pair of exciter mechanisms transmit forces to and between the side walls via the modular exciter beam, wherein each of the end fittings is formed as a housing, wherein walls of the housing are chamber walls that enclose a chamber therein, wherein each of the end fittings have a first flanged connector that connects to the connection member and a second flanged connector that mounts to the inside face of the side walls, wherein the chamber walls extend between the first flanged connector and the second flanged connector, such that the first flanged connector is provided at a first end of the housing and the second flanged connector is provided at a second end of the housing, and wherein each of the end fittings is a unitary, cast component.

3. The modular exciter beam as claimed in claim 1, wherein the end fittings each include one or more internal stress webs interconnecting one or more of the chamber walls.

4. The modular exciter beam as claimed in claim 1, wherein the end fittings each include a platform to which the corresponding exciter mechanism mounts, the platform being located entirely between the side walls of the vibratory screen assembly.

5. The modular exciter beam as claimed in claim 4, wherein the platform extends at least partly beyond the chamber walls and includes at least some fastening holes exposed for fastening of the corresponding exciter mechanism.

6. The modular exciter beam as claimed in claim 4, wherein the platform includes at least some fastening holes that exit within the end fitting for fastening internally of the end fitting.

7. The modular exciter beam as claimed in claim 1, wherein the end fittings include one or more access windows in the first flanged connector and the second flanged connector, the one or more access windows designed to provide access for fastening of the end fittings to either the corresponding side walls or the connection member.

8. The modular exciter beam as claimed in claim 7, wherein the access windows of the end fittings align with a corresponding access window in the side walls of the vibratory screen assembly.

9. The modular exciter beam as claimed in claim 1, wherein each end of the connection member includes a flanged connector for detachable coupling to the respective end fitting via a plurality of fasteners.

10. The modular exciter beam as claimed in claim 1, wherein the connection member detachably connects to the end fittings independent of their connection to the side walls of the vibratory screen assembly.

11. The modular exciter beam as claimed in claim 1, further including a clamp connector for detachably coupling the connection member at each of its ends to the respective end fitting.

12. The modular exciter beam as claimed in claim 1, wherein the connection member is a tubular member.

13. The modular exciter beam as claimed in claim 12, wherein the connection member has a round cross-section.

14. The modular exciter beam as claimed in claim 1, wherein the connection member is prefabricated in a predetermined length dependent on the separation between the opposing side walls.

15. The modular exciter beam as claimed in claim 1, wherein the modular exciter beam is configured to retrofit to an existing vibratory screen assembly.

16. The module exciter beam as claimed in claim 1, further comprising at least one internal stress web that interconnects the chamber walls, the at least one stress web being positioned inside of the chamber of the housing formed by the chamber walls, such that the at least one internal stress web is positioned in the housing at a position between the first flanged connector and the second flanged connector.

17. The module exciter beam as claimed in claim 11, wherein the clamp connector includes multiple clamp segments that are attached together to couple the connection member and the respective end fittings.

* * * * *